US005181248A

United States Patent [19]

Inanaga et al.

[11] Patent Number: 5,181,248

[45] Date of Patent: Jan. 19, 1993

[54] ACOUSTIC SIGNAL REPRODUCING APPARATUS

[75] Inventors: Kiyofumi Inanaga, Kanagawa; Yashuhiro Iida, Tokyo; Hiroyuki Sogawa, Kanagawa; Susumu Yabe, Tokyo, all of Japan

[73] Assignee: Sony Corporation, Tokyo, Japan

[21] Appl. No.: 641,681

[22] Filed: Jan. 16, 1991

[30] Foreign Application Priority Data

Jan. 19, 1990 [JP] Japan ..... 2-008516

[51] Int. Cl.[5] ..... H04R 5/00

[52] U.S. Cl. ..... 381/25; 381/74

[58] Field of Search ..... 381/1, 24, 25, 74

[56] References Cited

U.S. PATENT DOCUMENTS

| | | | |
|---|---|---|---|
| 3,962,543 | 6/1976 | Blauert et al. | 381/25 |
| 4,388,494 | 6/1983 | Schone et al. | 381/1 |
| 4,975,954 | 12/1990 | Cooper et al. | 381/1 |

FOREIGN PATENT DOCUMENTS

| | | | |
|---|---|---|---|
| 2918831 | 11/1980 | Fed. Rep. of Germany . | |
| 204200 | 10/1985 | Japan | 381/74 |
| 2-72798 | 3/1990 | Japan . | |
| 2-72799 | 3/1990 | Japan . | |
| 2-72800 | 3/1990 | Japan . | |

OTHER PUBLICATIONS

Patent Abstracts of Japan, No. 890,814 Dec. 7, 1983.

Patent Abstracts of Japan, No. 58116900 May 12, 1989.

*Primary Examiner*—Forester W. Isen

*Assistant Examiner*—Nina Tong

*Attorney, Agent, or Firm*—Lewis H. Eslinger; Jay H. Maioli

[57] ABSTRACT

An acoustic signal reproducing apparatus for reproducing acoustic signals through headphone devices is disclosed. The left channel and right channel acoustic signals are provided by a device for processing the transmission characteristics with constant transmission characteristics representing the location of an imaginary sound source relative to both of the listener's ears. The left channel and right channel acoustic signals, processed in this manner by the device for processing the transmission characteristics, are provided by an acoustic signal processing device with a level difference and a time difference consistent with changes in orientation of the user's head. In this manner, optimum binaural reproduction with respect to the imaginary sound source may be achieved.

5 Claims, 5 Drawing Sheets

FIG. 2(A) POSITION-SENSING REFERENCE SIGNAL

FIG. 2(B) OUTPUT OF POSITION SENSOR 5L

FIG. 2(C) OUTPUT OF POSITION SENSOR 5R

FIG. 2(D) OUTPUT OF FIRST EDGE DETECTION CIRCUIT 15

FIG. 2(E) OUTPUT OF SECOND EDGE DETECTION CIRCUIT 16

FIG. 2(F) OUTPUT OF THIRD EDGE DETECTION CIRCUIT 17

ACOUSTIC SIGNAL REPRODUCING APPARATUS

BACKGROUND OF THE INVENTION

Field of the Invention

This invention relates to an apparatus for reproducing acoustic signals by a headphone device.

In reproducing acoustic signals using a pair of headphone units mounted on the listener's head and applied in the vicinity of the listener's ears, as in the case of a headphone apparatus for reproducing the acoustic signals by headphone units, there has been known a binaural system as means for optimizing the sense of the direction of a sound image or the sense of the sound source lying at some fixed position outside the listener's head.

With the binaural acoustic signal reproducing system, as disclosed for example in the Japanese Patent Kokoku Publication No. 283/1978, the acoustic signals reproduced by the headphone device are subjected in advance to a predetermined signal processing.

The sense of the direction of the sound image, or the sense of the sound source lying at some fixed position outside of the listener's head, are governed by the difference in sound volume, and time as well as in the phase of the sounds heared by the left and right ears.

The above mentioned signal processing refers to signal processing which, when the acoustic sound is to be reproduced by the speaker units, the acoustic effects equivalent to those produced by the difference in distance from the sound source, that is, the speaker units, placed at some distance from the listener, to the listener's left and right ears, or the reflection or diffraction in the vicinity of the listener's head may be simulated in the acoustic output reproduced by the headphone device. Such signal processing may be realized by subjecting the acoustic signals for the listener's left and right ears to, for example, convolutional integration of the impulse response corresponding to the above mentioned acoustic effects.

Meanwhile, when the acoustic sound is to be reproduced by speaker units placed at a distance from the listener, the absolute position of the sound image is not changed even if the listener has moved his or her body or head, so that the relative direction or position of the sound image felt by the listener is changed. Conversely, when the acoustic sound is reproduced in accordance with the binaural system, using the headphone device, the headphone device is moved with the listener's head when the listener has turned his or her head, so that the relative direction and position of the sound image as sensed by the listener remain unchanged.

In this manner, when the acoustic sound is reproduced in accordance with the binaural system, using the headphone device, the sound field may be formed within the listener's head, on account of the difference in the state of shift of the sound image with respect to the change in the orientation of the listener's head, with the result that the sound image cannot be easily fixed at a position ahead of the listener. In addition, the sound image lying ahead of the listener tends to be moved upwards.

There has also been proposed an acoustic signal reproducing system in which, as described in Japanese Patent Kokai Publication No. 227/1967 or Japanese Patent Kokoku Publication No. 19242/1979, the changes caused in the orientation of the listener's head are sensed, and the signal processing state is changed on the basis of the sensed results so as to provide an optimum forward fixed sound source orientation feeling for the headphone device. With this type of acoustic signal reproducing system, a direction sensor, such as a gyrocompass or magnetic needle, is positioned on the listener's head. The above mentioned level adjustment circuit and the delay circuit, adapted for processing acoustic signals, are controlled on the basis of the results of detection by the direction sensor to provide the ambience of a sound field similar to that provided by sound reproduction by the speaker units placed at some distance from the listener.

With the above described conventional binaural acoustic reproducing system, in which gyrocompass or the like direction sensor is provided in the headphone device, the contents of signal processing for the acoustic signals dependent upon the changes in the direction of the listener's head may be controlled to provide a satisfactory fixed sound image orientation feeling.

However, for controlling the contents of the signal processing for the acoustic signals in dependence upon changes in the listener's head position, it is necessary to measure in advance the impulse response, that is the transmission characteristics, corresponding to the acoustic effects applied to acoustic signals for left and right ears, for each of predetermined angles, to store voluminous transfer characteristic data in storage means and to read out the data responsive to occasional changes in the listener's head position, for performing the necessary real-time convolutional integration of the acoustic signals. A processing apparatus with a large processing capacity and a high processing speed needs to be employed as processing means executing such real time convolutional integration with variable coefficients.

OBJECT AND SUMMARY OF THE INVENTION

It is a principal object of the present invention to provide an acoustic signal reproducing apparatus of a simplified structure whereby binaural sound reproduction may be achieved with natural fixed sound image orientation feeling without shifting of the imaginary sound source position by the headphone device as a result of listener's bodily movements.

In accordance with the present invention, there is provided an acoustic signal reproducing apparatus comprising means for detecting the rotational angular position of the listener's head, means for calculating changes in the orientation of listener's head relative to an imaginary sound source on the basis of output signals from said detection means, transmission characteristic processing means for providing left channel and right channel acoustic signals with constant transmission characteristics derived from the orientation of the imaginary sound source relative to both ears of the listener, and acoustic signal processing means for providing the left channel and right channel acoustic signals processed by the transmission characteristic processing means with the level difference and the time difference consistent with changes in the direction of the listener's head as determined by said calculating means, the acoustic signals processed by the acoustic signal processing means being reproduced by a headphone device.

With the acoustic signal reproducing apparatus of the present invention, since the constant transmission characteristics from the imaginary sound source as far as the listener's ears are afforded by transfer characteristic processing means to the left channel and right channel acoustic signals, the acoustic signals of both channels may be provided with the necessary transmission characteristics by means of the simplified calculating device without the necessity of variably controlling the coefficients of the transmission characteristic processing means on the real time basis. In addition, the acoustic signals of the respective channels processed by the transmission characteristic processing means are provided by the acoustic signal processing means with the level difference and the time difference consistent with the changes in the orientation of the listener's head as determined by the calculating device, and the acoustic signals thus processed by the acoustic signal processing means are supplied to the headphone device. In this manner satisfactory binaural reproduction may be achieved with highly natural fixed sound image orientation feeling without the position of the imaginary sound source being moved with listener's bodily movements.

DESCRIPTION OF PREFERRED EMBODIMENT

Figure 1:
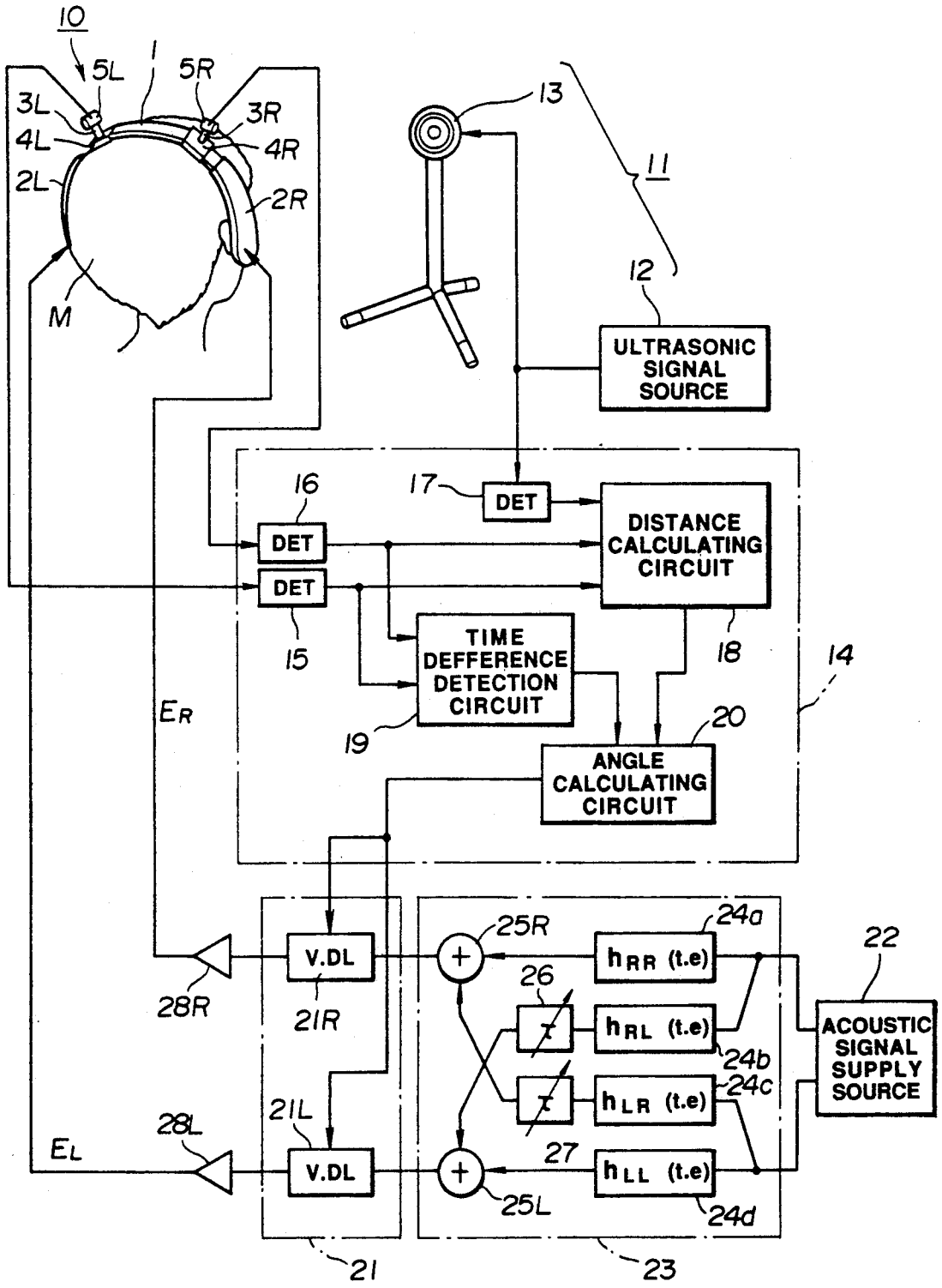
FIG. 1 is a schematic block diagram showing the construction of an acoustic signal reproducing apparatus according to the present invention.

By referring to the drawings, an illustrative embodiment of an acoustic signal reproducing apparatus according to the present invention will be explained in detail.

Referring first to FIG. 1, an acoustic signal reproducing apparatus according to the present invention includes a headphone device 10 worn at the listener's head M by a head band 1 and adapted for supporting a pair of headphone units 2L, 2R in the vicinity of the listener's left and right auricles.

Two sliders 4L, 4R carrying upstanding supporting arms 3L, 3R are slidably mounted on the head band 1 of the headphone device 10, and a pair of signal sensors 5L, 5R for sensing the position-detecting reference signals from a reference signal source 11 are mounted on the distal ends of the supporting arms 3L, 3R. In this manner, the signal sensors 5L, 5R, mounted on the distal ends of the supporting arms 3L, 3R mounted upright on the sliders 4L, 4R in turn slidably mounted on the head band 1, are supported at the distal ends of the supporting arms 3L, 3R at a distance from the head band 1 and a pair of headphone units 2L, 2R constituting the headphone main body.

The reference signal source 11 in the present embodiment is made up of an ultrasonic signal source 12 and an ultrasonic speaker 13 transmitting the ultrasonic signals from the source 12 as the position-detecting reference signals. The signal sensors 5L, 5R for sensing the reference signals each consist of ultrasonic microphones.

Figure 2:
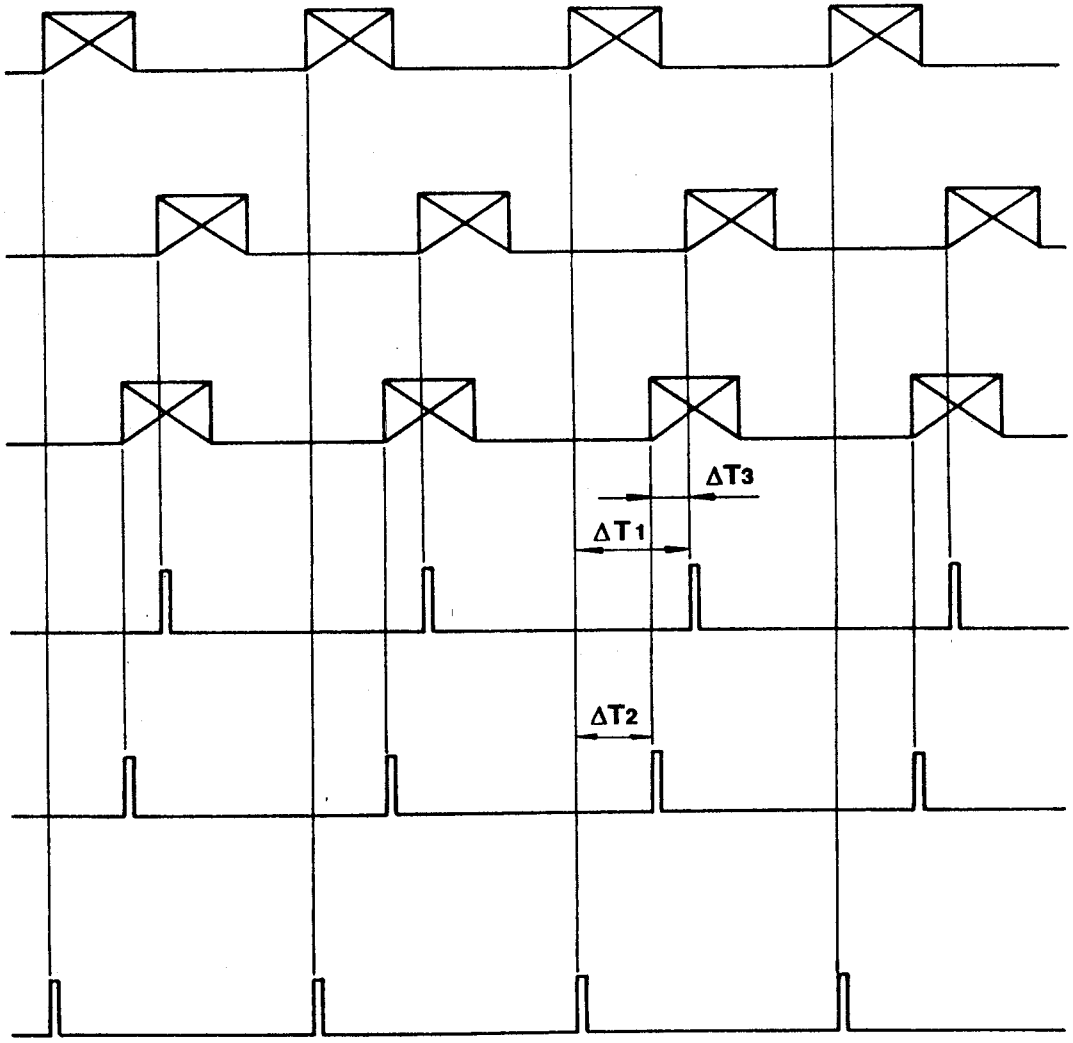
FIG. 2 is a time chart illustrating the state of signals supplied to a calculating device of the acoustic signal reproducing apparatus shown in FIG. 1.

The ultrasonic signals, that is the position-detecting reference signals transmitted from the ultrasonic speaker 13, shown at A in FIG. 2, are phase detectable ultrasonic waves, such as burst ultrasonic waves having a predetermined level and transmitted intermittently at a predetermined period, or so-called level-modulated waves exhibiting level fluctuation at a predetermined period.

The signal sensors 5L, 5R, provided on the headphone device 10, are responsive to the position-detecting ultrasonic reference signals from the ultrasonic speaker 13 to output detection signals, shown at B and C in FIG. 2, respectively, having relative time lags consistent with the relative position between the listener and the ultrasonic speakers 13.

The signal sensors 5L, 5R, provided at the distal ends of the supporting arms 3L, 3R mounted upright on sliders 4L, 4R mounted in turn on the head band 1, are supported by the supporting arms 3L, 3R at a position spaced apart from the head band 1 and the headphone units 2L, 2R of the main headphone body when the main headphone body is attached to the listener's head. Thus the signal sensors 5L, 5R may not be hidden by the listener's head when the listener moves his or her head or body, so that the ultrasonic waves transmitted from the ultrasonic speaker 13 may be sensed satisfactorily and the position-sensing reference signals maybe detected stably and accurately. The signal sensors 5L, 5R may be adjusted to an optimum position for detecting the position-sensing reference signal by sliding the sliders 4L, 4R along the head band 1. Since the position of the headphone units 2L, 2R, mounted on the listener's head M by the head band 1 so as to be supported in the vicinity of the listener's left and right auricles, depends on the shape and the size of the listener's head M and hence differs from person to person, the position of the signal sensors 5L, 5R need to be adjusted in association with the position of the headphone units 2L, 2R.

The detection signals produced from the signal sensors 5L, 5R, are transmitted to a calculating unit 14.

The calculating unit 14 includes first and second edge detection circuits 15 and 16, supplied with detection signals by the signal sensors 5L, 5R or the position-detecting reference signals, respectively, and a third edge detection circuit 17, supplied with the ultrasonic signals from the ultrasonic signal source 12, that is the position-detecting reference signals.

The first and second edge detection circuits 15, 16 detect the rising edges of the detection signals from the signal sensors 5L, 5R, respectively, for outputting pulse signals associated with the rising edges, as shown at D and E in FIG. 2. The pulse signals from the first and second edge detection circuits 15, 16 are supplied to a distance calculating circuit 18 and a time difference detection circuit 19. The third edge detection circuit 17 detects the rising edges of the ultrasonic signals from the ultrasonic signal source 12 to output pulse signals, shown at F in FIG. 2, associated with the rising edges. The pulse signals produced by the third edge detection circuit 17 are supplied to the distance calculating circuit 18.

The distance calculating circuit 18 detects a time difference $t_1$, shown at $\Delta T_1$ in FIG. 2, between the pulse signal obtained by the third edge detection circuit 17 and the pulse signal obtained by the first edge detection circuit 15, and a time difference $t_2$, shown at $\Delta T_2$ in FIG. 2, between the pulse signal obtained by the third edge detection circuit 17 and the pulse signal obtained by the second edge detection circuit 16. The calculating circuit 18 then calculates, on the basis of the time difference $t_1$ and $t_2$ and the sound velocity V, the distance $l_O$, shown by an arrow in FIG. 3, between the ultrasonic speaker 13 and the center of the listener's head M.

The sound velocity $V_0$ may be preset as a constant in the distance calculating circuit 18, or adapted to be changed as a function of changes in temperature, humidity or atmospheric pressure. The calculated distance $l_0$ may be compensated on the basis of the relative positions of the signal sensors 5L, 5R with respect to the center of the head M or the shape and/or size of the head M.

The signals for the distance $l_0$ and the time differences $t_1$ and $t_2$ are transmitted to an angle calculating circuit 20.

The time difference detection circuit 19 detects a time difference $t_3$, shown by $\Delta T_3$ in FIG. 2, between the pulse signal from the first edge detection circuit 15 and the pulse signal from the second edge detection circuit 16. The signal for the time difference $t_3$ is supplied to the angle calculating circuit 20.

Figure 3:
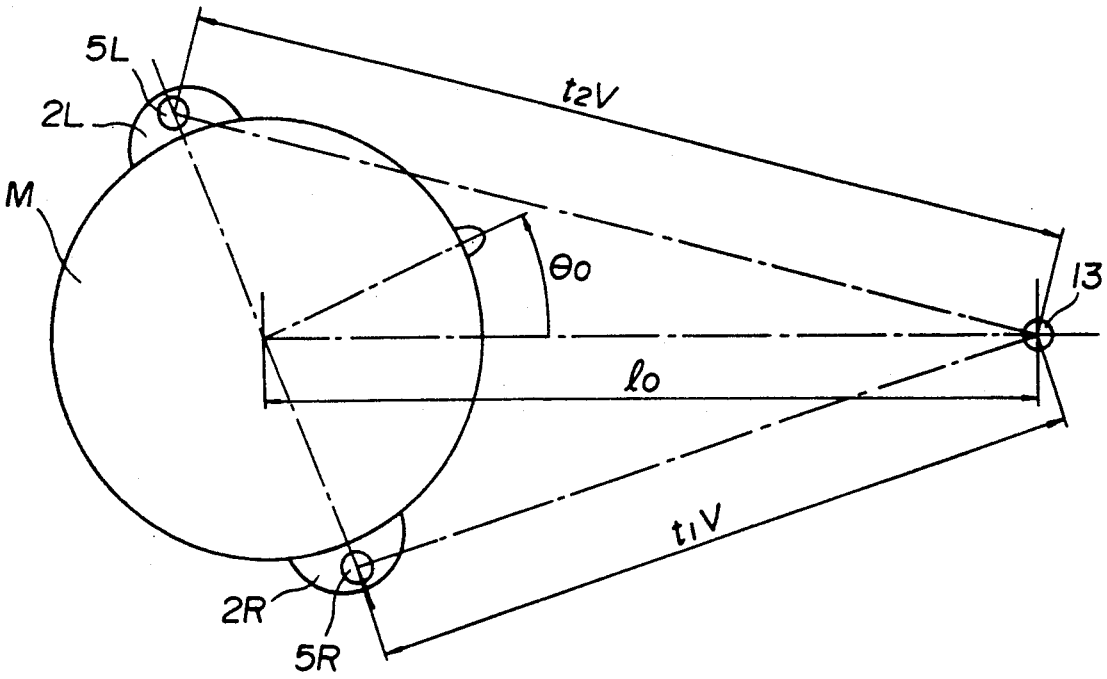
FIG. 3 is a diagrammatic view illustrating the distance and the angle calculated by the calculating device of the acoustic signal reproducing apparatus shown in FIG. 1.

The angle calculating circuit 20 calculates, from the time differences $t_1$, $t_2$ and $t_3$, distance $l_0$, sound velocity V and the radius r of the head M, an angle $\theta_0$, shown by an arrow in FIG. 3, indicating the orientation of the listener's head M. The angle $\theta_0$ may be found by, for example, the following formula $$\theta_0 \doteqdot \sin^{-1}\{V^2(t_1+t_2)t_3/4rl\} \quad (1)$$

and, with the position of the ultrasonic speaker 13 as the reference position of the imaginary sound source, the rotational angle $\theta$ of the listener's head M with respect to a desired imaginary sound source and the relative distance of the listener's head M from the imaginary sound source are calculated to find an angular position which takes into account the directivity or the like of the desired imaginary sound source.

The angular position information, produced by the angle calculating circuit 20, is supplied to an acoustic signal processing circuit 21.

Left channel and right channel acoustic signals $S_L$, $S_R$, outputted from an acoustic signal supply source 22, are supplied to the acoustic signal processing circuit 21 by means of a transmission characteristic processing circuit 23.

Meanwhile, the acoustic signal supply source 22 is a unit for outputting predetermined left channel and right channel acoustic signals $S_L$, $S_R$, and may for example be one of a variety of disk recording/reproducing apparatus, tape recording/reproducing apparatus or a radio receiver.

The transmission characteristic processing circuit 23 is a circuit for performing a predetermined signal processing operation for providing the left and right channel acoustic signals $S_L$, $S_R$ from the source 22 with predetermined transmission characteristics representing the location of the imaginary sound source relative to both of the listener's ears, and includes first to fourth signal processing sections **24*a*, 24*b*, 24*c* and 24*d* having preset coefficients providing the above mentioned transmission characteristics. In each of these signal processing sections 24*a* to 24*d***, an impulse response indicative of transmission characteristics to each ear of the listener in reproducing the left and right channel acoustic signals SL and SR is set, with a pair of speaker units for the left and right channels, installed opposite to the listener and at some distance from each other as an imaginary or virtual sound source, on the basis of the above mentioned transmission characteristic information.

Thus the first signal processing section **24*a* sets an impulse response $\{h_{RR}(t, \theta)\}$ indicative of transmission characteristics to the right ear of the sound reproduced from the right channel acoustic signal $S_R$. The second signal processing section 24*b* sets an impulse response $\{h_{RL}(t, \theta)\}$ indicative of transmission characteristics to the left ear of the sound reproduced from the right channel acoustic signal $S_R$. The third signal processing section 24*c* sets an impulse response $\{h_{LR}(t, \theta)\}$ indicative of transmission characteristics to the right ear of the sound reproduced from the left channel acoustic signal $S_L$. Finally, the fourth signal processing section 24*d*** sets an impulse response $\{h_{LL}(t, \theta)\}$ indicative of transmission characteristics to the left ear of the sound reproduced from the left channel acoustic signal $S_L$.

Meanwhile, these impulse responses may be previously set in association with transmission characteristics, taking the directivity or the like features of the imaginary sound source into account, and stored in a memory, such as ROM, so as to be subsequently read out on the basis of the readout address determined from the distance and the angle $\theta$.

In the transmission characteristic processing circuit 23, the right channel acoustic signal $S_R$ is transmitted to the first and second signal processing sections **24*a* and 24*b*. In the first signal processing section 24*a*, the right channel acoustic signal $S_R$ is subjected to a signal processing by convolutional integration of the impulse response $\{h_{RR}(t, \theta)\}$. In the second signal processing section 24*b***, the right channel acoustic signal $S_R$ is subjected to signal processing by convolutional integration of the impulse response $\{h_{RL}(t, \theta)\}$.

The left channel acoustic signal $S_L$ is transmitted to the third and fourth signal processing sections **24*c*, 24*d*. In the third signal processing section 24*c*, the left channel acoustic signal $S_L$ is subjected to signal processing by convolutional integration of the impulse response $\{h_{LR}(t, \theta)\}$. In the second signal processing section 24*d***, the left channel acoustic signal $S_L$ is subjected to signal processing by convolutional integration of the impulse response $\{h_{LL}(t, \theta)\}$.

The output signal from the first signal processing section **24*a* is directly supplied to a right-hand adder 25R, while the output signal from the third signal processing section 24*c* is supplied by way of a variable delay circuit 27 to the right-hand adder 25R so as to be added thereat to the output signal from the first signal processing section 24*a*. The output signal from the right-hand adder 25R is supplied to a right-hand signal processing circuit 21R of the signal processing circuit 21. The output signal from the second signal processing section 24*b* is supplied by way of a variable delay circuit 26 to a left-hand adder 25L, while the output signal from the fourth signal processing section 24*d* is directly supplied to the left-hand adder 25L so as to be added thereat to the output signal from the second signal processing section 24*b*. The output signal from the left-hand adder 25L is supplied to a left-hand signal processing circuit 21L of the signal processing circuit 21**.

The variable delay circuits 26, 27 of the processing circuit 23 provide for variable time difference of the output crosstalk component signals of the second and third signal processing sections 24b, 24c, and are used for compensating the changes in the time difference of the crosstalk components caused by the difference in head size from person to person.

The left-hand signal processing circuit 21L and the right-hand signal processing circuit 21R of the acoustic signal processing circuit 21 operate responsive to the angular position information derived from the angle calculating circuit 20 to effect variable control of the level and delay characteristics so that the left and right channel acoustic signals $S_L$, $S_R$ supplied from the supply source 22 by means of the processing circuit 23 will be provided with the level difference and the time difference consistent with changes in the orientation of the listener's head.

The output signal from the right-hand signal processing circuit 21R is supplied by means of a right-hand amplifier 28R as an acoustic signal for right ear $E_R$ to the right-hand headphone unit 2R for reproduction. Similarly, the output signal from the left-hand signal processing circuit 21L is supplied by means of a left-hand amplifier 28L as an acoustic signal for left ear $E_L$ to the left-hand headphone 2L for reproduction.

With the above described acoustic signal reproducing apparatus, the rotational angle $\theta$ of the listener's head M relative to a desired position of an imaginary sound source and a relative distance l from the imaginary sound source are calculated by the angle detection circuit 14 on the basis of the information concerning the above mentioned angle $\theta_O$ and the distance $l_O$ indicative of the relative position between the listener's head M and a reference position of the imaginary sound source which is assumed to be the position of the ultrasonic speaker 13, in such a manner that the left- and right channel acoustic signals $S_L$, $S_R$ supplied from the processing circuit 23 to the headphone units 2L, 2R will be provided with the level difference and the time difference consistent with changes in orientation of the listener's head relative to the virtual sound source. In this manner, with the above described acoustic signal reproducing apparatus, signal processing for coping with changes in transmission characteristics caused by movements of the listener's body and head on the real time basis is performed by variably controlling the level difference and the time difference in the acoustic signal processing circuit 21, whereby, as may be seen from the relative position between the imaginary sound source and the listener as shown at A, B and C in FIG. 4, an optimum sense of the sound source position lying ahead of the listener and outside the listener's head without shifting of the imaginary sound source may be obtained in the same way as when the acoustic signals are reproduced by a pair of speaker units SL, SR positioned ahead of the listener P and at some distance from each other.

Figure 4A:
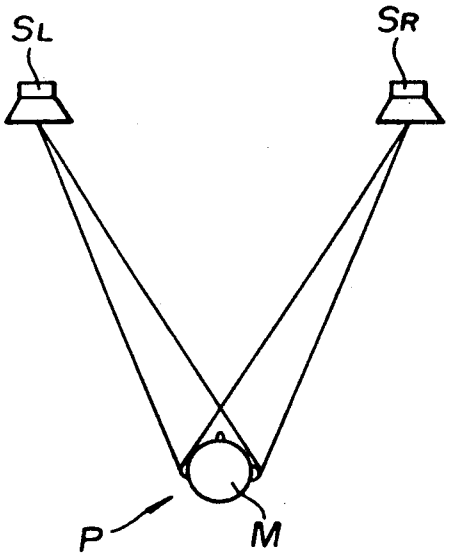
FIGS. 4 A, B and C are plan views showing the relative positions between the imaginary sound source and the listener for illustrating the state of the binaural reproduction by the acoustic signal reproducing apparatus shown in FIG. 1.
Figure 4B:
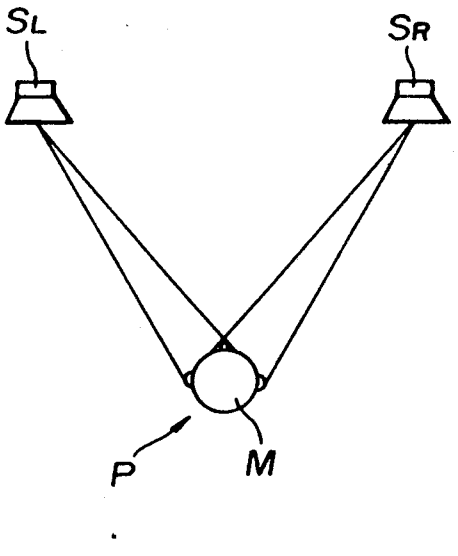
Figure 4C:
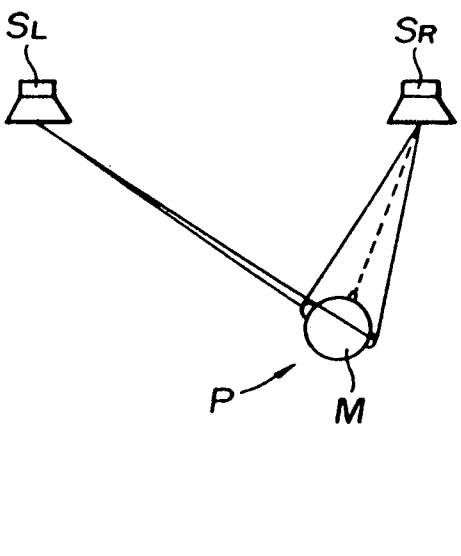

It will be noted that, in FIG. 4, as the listener P approaches the speaker units SL, SR, that is, the imaginary sound source, as shown at B, from his or her position shown at A, and further turns his head M towards the right hand speaker unit SR, as shown at C. With the acoustic signal reproducing apparatus of the present invention an optimum sense of the sound source position forwardly and outside the listener's head, with the imaginary sound source not being moved, may be obtained as a result of signal processing coping with changes in the transmission characteristics, caused by movement of the listener's head and body, on a real time basis, thereby providing for binaural reproduction capable of coping with any of the states shown at A to C in FIG. 4.

Figure 5:
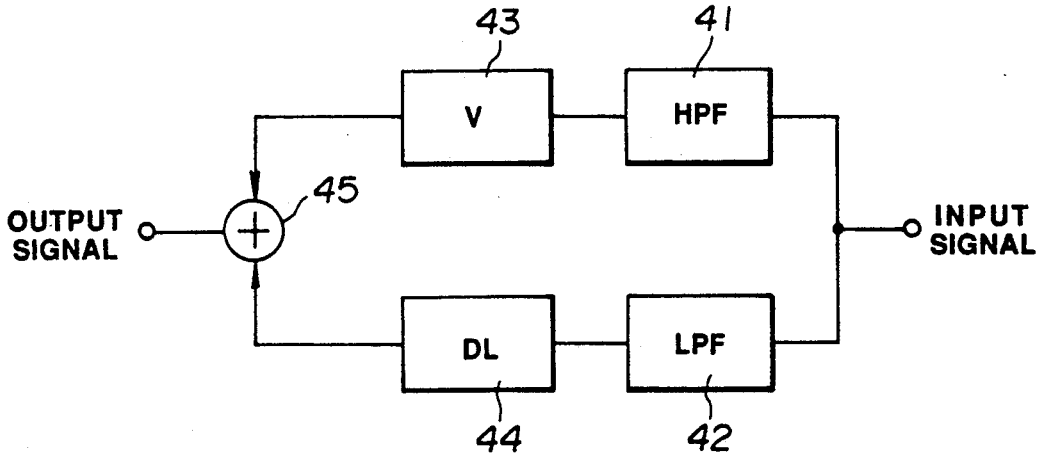
FIG. 5 is a block diagram showing the construction of an acoustic signal processing circuit for one of the channels employed in the acoustic signal processing apparatus shown in FIG. 1.

With the above described embodiment, the overall level and delay control is performed on the left and right channel acoustic signals $S_L$ and $S_R$ supplied from the processing circuit 23 to the headphone units 2L and 2R by way of left-hand and right-hand signal processing circuits 21L, 21R. Alternatively, the acoustic signals may be divided by a high pass filter 41 and a low pass filter 42, as shown in FIG. 5 for one of the left-hand and the right-hand channels, before proceeding to level and delay control in the manner described above. In this case, the high frequency component signal, obtained by means of the high pass filter 41, is supplied to a signal adder 45 after having been controlled in signal level by a variable level circuit 43 in accordance with changes in orientation of the listener's head relative to the imaginary sound source, whereas the low frequency component signal, obtained by means of the low pass filter 42, is supplied to the signal adder 45 after having been controlled in delay by a variable delay circuit 44 in accordance with the changes in orientation of the listener's head relative to the imaginary sound source.

What is claimed is:

1. An acoustic signal reproducing apparatus for use with headphone devices, comprising:

a reference signal source for transmitting a reference signal for detecting an orientation of a listener's head, a pair of signal detection means arranged at respective positions on the listener's head for receiving the reference signal transmitted by said reference signal source, calculating means for calculating changes in orientation of the listener's head relative to an imaginary sound source on the basis of output signals from said pair of signal detection means and producing an output signal representing said changes in orientation, transmission characteristic processing means including a plurality of signal processing sections receiving input left and right channel acoustic signals and having preset impulse response coefficients indicative of transmission characteristics to each ear of the listener for providing a left channel and a right channel of input acoustic signals with predetermined transmission characteristics representing the location of said imaginary sound source relative to the listener's ears, said plurality of signal processing sections comprising a first signal processing section for subjecting the right channel of said input acoustic signals to a convolutional integration of an impulse response indicative of constant transmission characteristics to the right ear of the listener of the acoustic signals reproduced from the right channel of the input acoustic signals, a second signal processing section for subjecting the right channel of said input acoustic signals to a convolutional integration of an impulse response indicative of constant transmission characteristics to the left ear of the listener of the acoustic signals reproduced from the right channel of the input acoustic signals, a third signal processing section for subjecting the left channel of said input acoustic signals to a convolutional integration of an impulse response indicative of constant transmission characteristics to the right ear of the listener of the acoustic signals reproduced from the left channel of the input acoustic signals, a fourth signal processing section for subjecting the left channel of said input acoustic signals to a convolutional integration of an impulse response indicative of constant transmission characteristics to the left ear of the listener of the acoustic signals reproduced from the left channel of the input acoustic signals, first adder means for adding an output of said first signal processing section and an output of said third signal processing section and producing the left channel signal, and second adder means for adding an output of said second signal processing section to an output of said fourth signal processing section and producing the right channel signal, and acoustic signal processing means receiving the right and left channel signals output respectively from said first and second adder means of said transmission characteristic processing means for controlling the level and delay characteristics thereof in response to said output signal representing said changes in orientation from said calculating means, the input acoustic signals being reproduced by the headphone devices from outputs of said acoustic signal processing means.

2. The acoustic signal reproducing apparatus according to claim 1 wherein said reference signal source comprises an ultrasonic signal source and an ultrasonic speaker for transmitting an ultrasonic signal from said ultrasonic signal source as the reference signal, characterized in that said pair of signal detection means comprise respective ultrasonic microphones.

3. The acoustic signal reproducing apparatus according to claim 1 wherein said calculating means comprises distance calculating means for calculating a distance between the listener and the reference signal source using a phase difference between said reference signal and detection signals from said pair of signal detection means, and time difference detection means for detecting a time difference between said detection signals from said pair of the signal detection means, characterized in that the angular position of the listener's head relative to the imaginary sound source is calculated using an output of said distance calculating means and an output of said time difference detection means.

4. The acoustic signal reproducing apparatus according to claim 1 further comprising a first variable delay circuit for delaying the output of said second signal processing section and a second variable delay circuit for delaying the output of said third signal processing section.

5. The acoustic signal reproducing apparatus according to claim 1 characterized in that said acoustic signal processing means comprises, for each of the right channel and left channel signals output respectively from said first and second adder means of said transmission characteristic processing means having predetermined transmission characteristics, a high pass filter supplied with the output of said transmission characteristic processing means, a low pass filter supplied with the output of said transmission characteristic processing means, level control means supplied with the output of said high pass filter, delay control means supplied with the output of said low pass filter and adder means for adding the output of said level control means to the output of said delay control means.

* * * * *